US005498451A

United States Patent [19]

Lafond

[11] Patent Number: 5,498,451

[45] **Date of Patent: *Mar. 12, 1996**

[54] METAL SPACER FOR INSULATED GLASS ASSEMBLIES

[76] Inventor: Luc Lafond, 23 Woodvalley Dr., Etobicoke, Ontario, Canada, N9A 4H4

[ * ] Notice: The term of this patent shall not extend beyond the expiration date of Pat. No. 5,443,871.

[21] Appl. No.: 417,896

[22] Filed: Apr. 6, 1995

Related U.S. Application Data

[63] Continuation-in-part of Ser. No. 964,051, Oct. 21, 1992, Pat. No. 5,443,871.

[30] Foreign Application Priority Data

Oct. 25, 1991 [CA] Canada ..... 2054272
Apr. 2, 1992 [CA] Canada ..... 2064988

[51] Int. Cl.[6] ..... E06B 3/24

[52] U.S. Cl. ..... 428/34; 428/156; 428/172; 428/174; 428/182; 428/213; 52/786.13

[58] Field of Search ..... 428/174, 34, 99, 428/156, 172, 119, 182, 192, 213, 457; 52/788, 790

[56] References Cited

U.S. PATENT DOCUMENTS

| | | | |
|---|---|---|---|
| 2,625,717 | 1/1953 | Wampler et al. | 428/34 |
| 2,708,774 | 5/1955 | Seelen | 428/34 |
| 4,042,736 | 8/1977 | Flint | 428/34 |
| 4,393,105 | 7/1983 | Kreisman | 428/34 |
| 4,476,169 | 10/1984 | Nishino et al. | 428/34 |
| 4,576,841 | 3/1986 | Lingemann | 428/34 |
| 4,850,175 | 7/1989 | Berdan | 52/790 |

*Primary Examiner*—Donald J. Loney
*Attorney, Agent, or Firm*—McFadden, Fincham

[57] ABSTRACT

A metal spacer having an area of reduced thickness between substrate engaging members. The reduction in thickness not only provides for reduced thermal transmission between the substrate engaging members and thus the substrates engaged therewith but further permits the spacer to absorb any negative or positive pressure translated to the spacer body by substrates contacting the spacer. For enhanced strength, the portion of reduced thickness may be bent in any one of a number of configurations depending upon the requirements and potential pressure to be experienced by the spacer or any assembly including the spacer. In a further embodiment, the metal spacer body may be embossed to enhance strength. The result of the spacer is a light-weight spacer element with reduced energy transmission between substrates engaged therewith.

22 Claims, 2 Drawing Sheets

METAL SPACER FOR INSULATED GLASS ASSEMBLIES

This is a continuation-in-part of U.S. Ser. No. 07/964,051 filed Oct. 21, 1992 now U.S. Pat. No. 5,443,871.

FIELD OF THE INVENTION

The present invention relates to spacer elements for insulated glass assemblies.

BACKGROUND OF THE INVENTION

The prior art has proposed a significant number of spacers for use in insulated glass assemblies as well assemblies incorporating the spacers. Generally speaking, in the prior art many of the spacers comprise either metal strips suitably formed into a spacer arrangement or plastic bodies for spacing the substrates. In terms of the metal spacers, U.S. Pat. No. 2,708,774, teaches a multiple-glazed unit where the unit includes a metal spacer which is in direct contact with the substrates. The patentee provides a host of different shapes for the spacer, some of which are purported to absorb stress, etc. between the glass panes. Although a generally useful arrangement, the spacer is in direct contact with the glass substrates and thus a clear thermal bridge is established. The spacer set forth in this reference does not reduce or redirect thermal transmission from one pane to the other via the spacer.

Similar to the above reference, U.S. Pat. No. 4,393,015, issued Jul. 12, 1983 to Kreisman, provides a C-shaped metal spacer which is in direct contact with the substrates it spaces. Mastic material is provided for adhesive purposes between the substrates. The patentee illustrates several alternate embodiments including annular, perannular, rectangular and other such shapes, however, all of the shapes of the spacer directly contact each of the substrates and accordingly, would appear to clearly provide a thermal transmission path from one substrate through the other which, in turn, reduces the energy efficiency of the overall assembly.

Berdan, in U.S. Pat. No. 4,850,175, issued Jul. 25, 1989, provides a spacer tube having a snap-on cap which may be filled with desiccant material. The spacer tube comprises a metal material, however, the degree of contact between the spacer tube and the substrates is significantly reduced in the Berdan tube design. This is an attractive feature from an energy point of view, however, the structural integrity of the spacer is compromised by this feature. The Berdan spacer, when in position between substrates, concentrates all of the force experienced by the substrates at two single flex points. The Berdan arrangement would appear to be susceptible to possible breakage at these bend points under stress over the course of time and may additionally disengage from a respective substrate.

Wampler et al., in U.S. Pat. No. 2,625,717, issued Jan. 20, 1953, provide a multiple sheet glazing unit which incorporates a generally U-shaped metal spacer. Similar to the above discussed references, this reference provides a spacer which would not be adequate for use in a high efficiency insulated glass assembly which additionally permits for pressure absorption. The spacer provided in the Wampler et al. reference comprises a rigid metal member for spacing the glass substrates attached thereto and would not be useful for either interrupting or breaking thermal transmission flow from one pane to the other.

Other references which are generally relevant, but which do not alleviate the energy and structural integrity problems currently existing in the spacer art include U.S. Pat. No. 4,042,736 issued to Flint, Aug. 16, 1977 and U.S. Pat. No. 4,476,169 issued to Nishino et al., Oct. 9, 1984.

In view of what has been proposed in the spacer art, there clearly exists a need for a highly energy efficient spacer assembly which creates energy savings, provides for a higher insulating glass assembly and further which does not compromise structural integrity in view of the aforementioned advantages.

SUMMARY OF THE INVENTION

One object of the present invention is to provide an improved spacer for use in insulated glass assemblies which substantially reduces the flow of thermal energy between glass lites engaged therewith, while at the same time providing a structurally secure spacer assembly which can endure pressure fluctuations commonly encountered in insulated glass assemblies.

A further object of the present invention is to provide a metal spacer body for positioning between glass substrates comprising: a pair of substrate engaging members, each member having a diagonally and inwardly directed support member; a bent segment joining the substrate engaging members in spaced relation, the bent segment for absorbing pressure realized by the substrate engaging members when the engaging members are in contact with the glass substrates.

The spacer body may comprise any suitable and reasonably flexible metal, e.g. steel, stainless steel, aluminum, suitable alloys, etc.

By making use of a trigonal arrangement, the spacer is particularly well adapted to inwardly directed forces, i.e. compression, while at the same time is useful in situations where the spacer is extended which would result in the sheet or sheets engaged with the spacer being pulled outwardly.

As an added feature, the spacer may incorporate a suitable desiccant between the substrate engaging members, and this may comprise any suitable desiccant material, either granular or positioned within a matrix. Where the desiccant is impregnated within a permeable matrix, the matrix will preferably comprise a semi-solid material, e.g. a silicon, urethane, etc. and will additionally impart further strength to the spacer while further damping the transmission of energy from one substrate engaging member to the other.

As an alternate feature, the metal body may include embossments in order to enhance the strength of the arrangement.

A further object of the present invention is to provide a metal spacer for spacing glass substrates in an insulated glass assembly comprising: a pair of generally triangular members, each member including a base, a glass substrate engaging surface for engaging a glass substrate and a diagonally and inwardly directed support member; at least one segment of reduced thickness integral with the spacer for reducing thermal transmission in the spacer.

It has been found that by reducing the thickness of the metal spacer in selected areas, the transmission of thermal energy from one pane to another through the spacer can be significantly reduced. In one example, the reduced thickness may be located between the triangular members. The reduction in thickness will depend on the type of metal employed in the spacer and the overall dimensions of the spacer and the assembly within which it is to be positioned. Typically, the ratio of the thickness of the remaining part of the spacer relative to the portion of reduced thickness may be in a ratio of from about 2.5:1 to about 1.1:1. It will be appreciated that significant variation can result in this ratio depending on the overall dimensions of the assembly, material employed, among other factors.

A further object of the present invention is to provide an insulated glass assembly comprising a pair of glass substrates; a metal spacer body between the glass substrates, the body including a pair of generally triangular members, each member including a base, a glass substrate engaging surface, each engaging surface engaged with a glass substrate, each triangular member including a diagonally and inwardly directed support member; a segment of reduced thickness integral with the spacer and joining the triangular members in spaced relation, the segment for reducing thermal transmission between the substrates engaged with the spacer.

In addition to the above-mentioned possibilities for thickness reduction, the diagonal portions of the spacer bar may include at least a portion of reduced thickness in order to further enhance the transmission of thermal energy from one side of the assembly to the other. Other possible combinations will be readily appreciated by those skilled in the art.

In alternate possible embodiments, the area of reduce thickness, when the same exists between the substrate engaging members, may comprise a linear segment, a half round, a sinusoidal shape, a single or multiple chevron shape or a zig-zag form. Selection of the shape will depend on the intended use of the assembly and the contemplated forces the assembly will experience.

A further alternate embodiment includes the provision of a composite material for the manufacture of the spacer. In such an arrangement, there may be a combination of metal and a polymeric substance. In one possibility, the metal spacer may be at least partly encased in a polymeric substance.

As a further possible embodiment, the metal spacer body may include small openings over the entire area of the spacer in order to accommodate dimensional variations which would naturally occur when the spacer is exposed to temperature fluctuations. In this manner, the openings could accommodate the expansion or contraction of the metal in the spacer in order to alleviate this stress at the point where the spacer joins the substrates.

Having thus generally described the invention, reference will now be made to the accompanying illustrating preferred embodiments.

BRIEF DESCRIPTION OF THE DRAWINGS

Similar numerals in the drawings denote similar components.

DETAILED DESCRIPTION OF THE PREFERRED EMBODIMENTS

Figure 1:
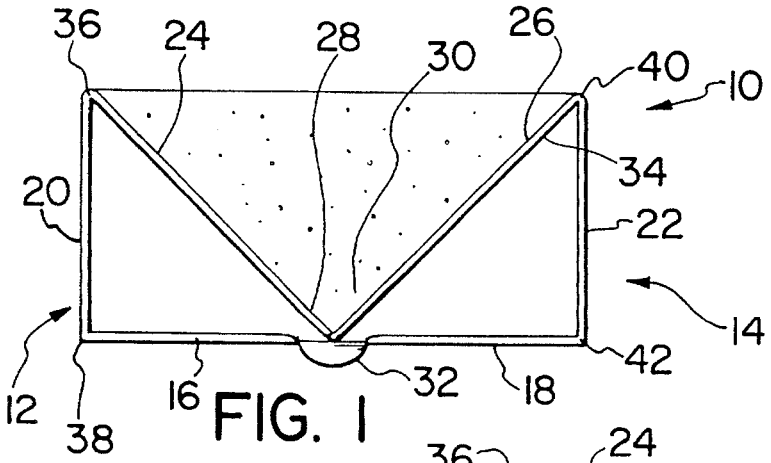
FIG. 1 is a side elevational view of one embodiment of the present invention.

Referring now to the drawings and specifically to FIG. 1, shown is a first embodiment of the spacer according to the present invention.

The spacer, generally denoted by numeral 10, comprises a metal body composed of a suitable metal. Examples of suitable metals include, for example, aluminum, steel, stainless steel and suitable alloys. In a preferred embodiment, the spacer 10 comprises a unitary body bent into the desired shape from steel strip.

The spacer 10 includes first and second generally triangular support members 12 and 14, which members are substantially identical and in this manner, provide a spacer which has a vertical plane of symmetry.

Each of the triangular support members 12 and 14, include a base 16 and 18, respectfully, a substrate engaging member 20 and 22 and diagonally and inwardly directed supports 24 and 26.

The ends 28 and 30 may be connected together as illustrated in FIG. 1 or alternatively, they may be attached to their respective bases 16 and 18, respectively.

In the example shown in FIG. 1, triangular members 12 and 14 are joined in spaced relation by a segment 32 which is of a reduced metal thickness relative to the remaining elements of the spacer body. In addition, ends 28 and 30 of support members 24 and 26, respectively, may also have a reduced metal thickness.

Figure 2:
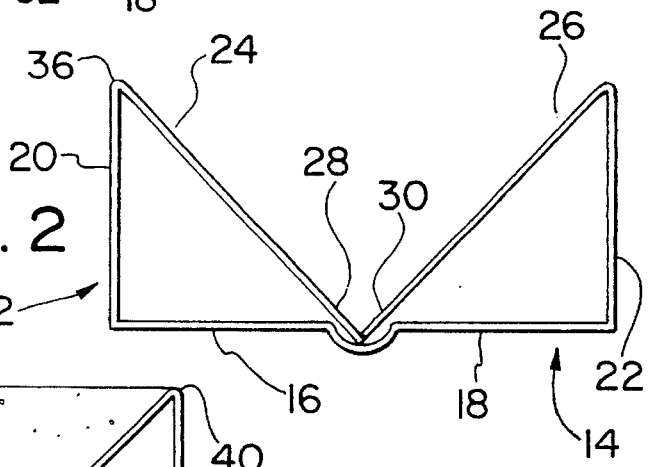
FIG. 2 is a side elevational view of an alternate embodiment of the present invention.
Figure 3:
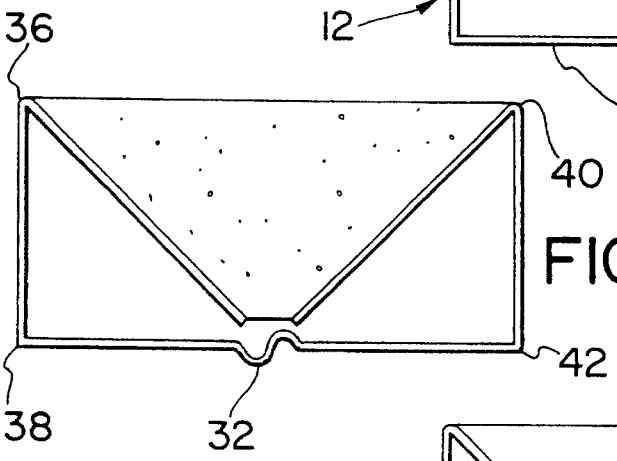
FIG. 3 is a side elevational view of yet another embodiment of the present invention.

Depending upon the specific requirements for the spacer 10, the ends 28 and 30 may be connected together, as discussed herein previously, or may be connected together and additionally connected to segment 32. This is shown in FIG. 2. Other alternatives for the connection of end portions 28 and 30 relative to the segment 32 and bases 16 and 18 will be readily appreciated by those skilled in the art.

Figure 6:
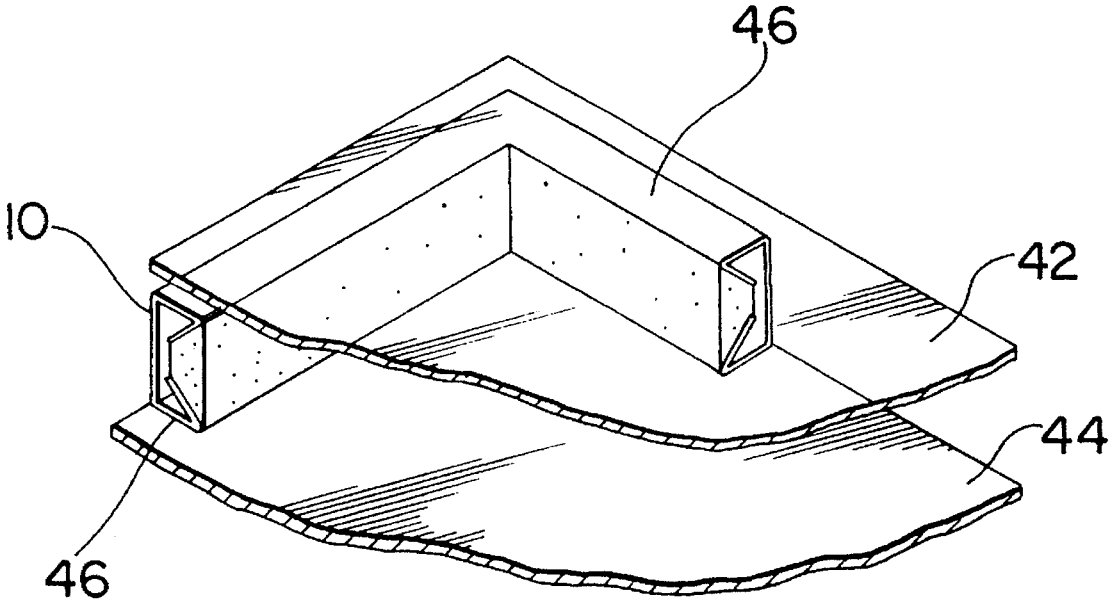
FIG. 6 is a perspective view of the spacer as positioned between substrates.

Regarding the remaining portions of the spacer body 10, the same may include embossments, all embossments being denoted by numeral 34. The embossments impart enhance structural integrity to the spacer body thus enabling the body 10 to endure compressive and expansive forces when the same is engaged between substrates, as shown in FIG. 6 and discussed in greater detail hereinafter.

In addition to the reduce thickness areas discussed hereinabove, namely those area denoted by numerals 28, 30 and 32, the individual flex points 36, 38, 40 and 42 on the spacer body may additionally be reduced in thickness.

Regarding the variation in the dimension of the areas mentioned hereinabove, it has been found that a slight reduction in the thickness dimension contributes to a lower thermal transmission, since the area available for the thermal energy to travel is reduced.

Generally speaking, in the prior art, the spacers previously proposed have been composed of a multiple number of pieces of metal, or have been composed of a single dimension of metal material without any variation in the dimension of the metal. With the present arrangement, significant reductions in energy transmission can be realized by simply varying the thickness of the metal used in the spacer strip at selected areas which do not compromise the structural integrity of the strip or the glass assembly in which the strip is disposed. In order to achieve the desired thermal energy performance without the negative disadvantage of structural compromise, the use of embossments on the surface of the metal spacer have been found to be particularly effective in enhancing the overall strength of the arrangement without departing from the desired triangular arrangement.

Regarding the reduced thickness, an effective ratio of the thickness of the remaining elements of the spacer relative to the portions of reduced thickness may be from about 2.5:1 to about 1:1. Depending on the specific application of the spacer, variation within this ratio will be appreciated by those skilled in the art. The ratio indicated hereinabove has been found effective since the thermal efficiency can be maximized in this range while the structural integrity of the spacer is not compromised.

Figure 4:
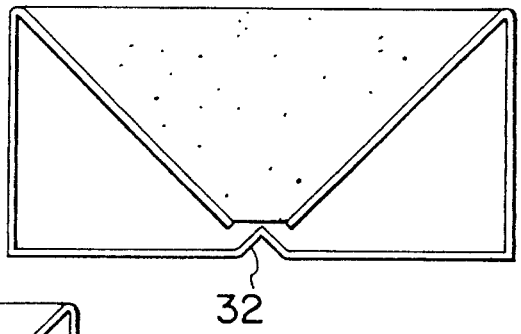
FIG. 4 is a side elevational view of yet another embodiment of the present invention.
Figure 5:
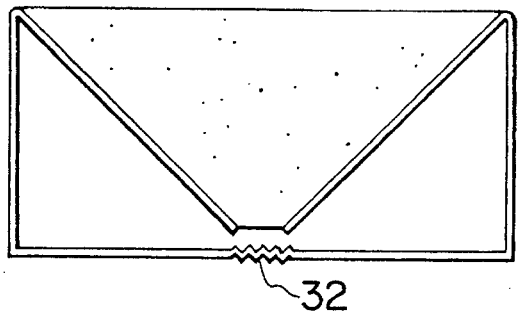
FIG. 5 is a side elevational view of yet another embodiment of the present invention.

In greater detail concerning segment 32, the same may be linear as illustrated in FIG. 1 or may be bent as illustrated, in variation, by FIGS. 2 through 5. In FIG. 2, the segment comprises a half round, whereas in FIG. 3, the segment comprises a sinusoidal or wave-like shape. FIG. 4 provides a chevron shape and FIG. 5 provides a zig-zag arrangement. It will be appreciated by those skilled in the art that numerous possible variations on the segment 32 are possible and that the examples herein are merely illustrative.

In order to further assist with the structural integrity of the spacer, the same may include desiccant, broadly denoted by numeral 40. The desiccant 40 may be of a loose granular form or, in a preferred form, will be dispersed within a permeable matrix of material such as, for example, silicon, urethane, etc. Where the desiccant 40 is dispersed within the matrix, the same will preferably extend between diagonal support members 24 and 26 as illustrated in the Figures. The provision of the semi-solid permeable matrix within which is disposed the desiccant, provides for additional support when the strip 10 is positioned between substrates 42 and 44 as illustrated in FIG. 6. In order to solidly fix the strip 10 between the substrates 42 and 44, a suitable sealant material 46, well known to those skilled in the art, may be positioned on substrate engaging members 20 and 22 in order to positively fix the strip between the substrates. Further, although not illustrated, additional sealant material may be positioned adjacent the base areas 16 and 18 of the strip 10 to complete the insulated glass assembly illustrated in FIG. 6.

It will be appreciated that various areas on the spacer may be of a reduced thickness and the examples set forth herein are to be construed as illustrative only. A primary advantage of the invention set forth herein is the use of a metal strip having a reduced thickness in various areas for the purpose of enhancing the energy efficiency of a metal strip in an insulated glass assembly.

As a further contemplated alternate embodiment, the metal strip may include apertures or slits within the metal body not only to impede thermal transmission within the spacer but further to allow for dimensional variation (contraction and expansion of the spacer body) during temperature fluctuation.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A metal spacer body for positioning between glass substrates comprising:

a pair of substrate engaging members, each member having a diagonally and inwardly directed support member a base extending between said substrate engaging members and including;

a bent segment joining said integral substrate engaging members in spaced relation, said bent segment for absorbing pressure realized by said substrate engaging members when said engaging members are in contact with said glass substrates.

2. The spacer as set forth in claim 1, wherein said spacer body comprises a steel strip.

3. The spacer as set forth in claim 2, wherein said strip includes a semi-solid desiccant matrix between said diagonally directed support members.

4. The spacer as set forth in claim 3, wherein said semisolid matrix comprises a urethane matrix.

5. The spacer as set forth in claim 1, wherein said bent segment comprises a half round.

6. The spacer as set forth in claim 1, wherein said spacer includes first and second generally triangular areas, said areas each including a base, a substrate engaging member and a diagonally oriented support member.

7. The spacer as set forth in claim 6, wherein each said diagonally oriented support member includes an end connected to said base.

8. A metal spacer for spacing glass substrates in an insulated glass assembly comprising:

a pair of generally triangular members, each member including a base, a glass substrate engaging surface for engaging a glass substrate and a diagonally and inwardly directed integral support member;

at least one segment of reduced thickness integral with said spacer for reducing thermal transmission in the spacer.

9. The metal spacer as set forth in claim 8, wherein said spacer further includes a semi-solid desiccant matrix between said diagonally oriented support members.

10. The metal spacer as set forth in claim 9, wherein said semi-solid desiccant matrix comprises a urethane matrix.

11. The metal spacer as set forth in claim 8, wherein said spacer comprises an embossed metal strip.

12. The metal spacer as set forth in claim 11, wherein said metal strip comprises steel.

13. The metal spacer as set forth in claim 9, wherein said at least one segment of reduced thickness joins said triangular members.

14. The metal spacer as set forth in claim 13, wherein said segment of reduced thickness comprises a linear segment.

15. The metal spacer as set forth in claim 13, wherein said segment of reduced thickness comprises a bent segment.

16. The metal spacer as set forth in claim 15, wherein said bent segment comprises a curved segment.

17. The metal spacer as set forth in claim 16, wherein said curved segment comprises a half round.

18. The metal spacer as set forth in claim 13, wherein said segment of reduced thickness comprises a sinusoidally shaped segment.

19. The metal spacer as set forth in claim 13, wherein said segment of reduced thickness includes at least one chevron.

20. The metal spacer as set forth in claim 13, wherein said segment of reduced thickness includes a zig-zag formation.

21. An insulated glass assembly comprising a pair of glass substrates;

a metal spacer body between said glass substrates, said body including a pair of generally triangular members, each member including a base, a glass substrate engaging surface, each said engaging surface engaged with a glass substrate, each said triangular member including a diagonally and inwardly directed integral support member;

a segment of reduced thickness integral with said spacer and joining said triangular members in spaced relation, said segment for reducing thermal transmission between said substrates engaged with said spacer.

22. The assembly as set forth in claim 21, wherein said assembly further includes desiccant means between said generally triangular members.

* * * * *